US008104402B2

(12) United States Patent
Feilecker et al.

(10) Patent No.: US 8,104,402 B2
(45) Date of Patent: Jan. 31, 2012

(54) HAND-OPERATED STAMP HAVING CONNECTING PART WITH INK REFILLING SOCKET

(75) Inventors: Alois Feilecker, Gunskirchen (AT); Hartwig Pointl, Scharnstein (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 600 days.

(21) Appl. No.: 12/087,911

(22) PCT Filed: Jan. 22, 2007

(86) PCT No.: PCT/AT2007/000025

§ 371 (c)(1),
(2), (4) Date: Sep. 9, 2008

(87) PCT Pub. No.: WO2007/082330

PCT Pub. Date: Jul. 26, 2007

(65) Prior Publication Data

US 2010/0251912 A1 Oct. 7, 2010

(30) Foreign Application Priority Data

Jan. 20, 2006 (AT) ..... A 101/2006

(51) Int. Cl.
*B41K 1/50* (2006.01)
*B41K 1/52* (2006.01)

(52) U.S. Cl. ..... 101/327; 101/333; 101/405

(58) Field of Classification Search ..... 101/327, 101/333, 405, 406, 368; *B41K 1/50, 1/52*
See application file for complete search history.

(56) References Cited

U.S. PATENT DOCUMENTS

| | | | | |
|---|---|---|---|---|
| 2,314,828 | A * | 3/1943 | Humphries | 101/324 |
| 3,832,947 | A | 9/1974 | Funahashi | |
| 4,676,162 | A | 6/1987 | Phipps, Sr. et al. | |
| 5,855,170 | A | 1/1999 | Shih | |
| 6,047,639 | A * | 4/2000 | Shih | 101/333 |
| 6,189,450 | B1 * | 2/2001 | Shih | 101/327 |
| 6,302,022 | B1 | 10/2001 | Shih | |
| 6,360,661 | B1 | 3/2002 | Cheung | |
| 6,526,882 | B1 * | 3/2003 | Shih | 101/327 |
| 2005/0061175 | A1 | 3/2005 | Sculler | |
| 2005/0132912 | A1 * | 6/2005 | Petersen | 101/333 |

FOREIGN PATENT DOCUMENTS

| | | |
|---|---|---|
| DE | 21 52 324 | 6/1972 |
| EP | 0 934 832 | 8/1999 |
| WO | WO 02/28658 | 4/2002 |

OTHER PUBLICATIONS

International Search Report from PCT/AT2007/00025, dated Mar. 7, 2007.

* cited by examiner

*Primary Examiner* — Leslie J Evanisko
(74) *Attorney, Agent, or Firm* — Collard & Roe, P.C.

(57) ABSTRACT

A hand-operated stamp (1) includes an at least partially open-pored printing plate (27) which can be displaced counter to a spring force, from a resting position in which it is retracted into a housing (2), into a printing position by an actuation element (3). The printing plate rests against an ink storage body (25) in order to receive stamping ink therefrom, the ink storage body being mounted in a holder (24) which at least partially encloses it. The holder (24) is trough-shaped and is directly locked with a connecting part (6) which is locked with the actuation unit and which comprises at least one refill support (40, 41) which is oriented towards an ink refill opening (42, 43) in the base wall of the holder (24).

15 Claims, 14 Drawing Sheets

HAND-OPERATED STAMP HAVING CONNECTING PART WITH INK REFILLING SOCKET

CROSS REFERENCE TO RELATED APPLICATIONS

This application is the National Stage of PCT/AT2007/000025 filed on Jan. 22, 2007, which claims priority under 35 U.S.C. §119 of Austrian Application No. A 101/2006 filed on Jan. 20, 2006. The international application under PCT article 21(2) was not published in English.

BACKGROUND OF THE INVENTION

1. Field of the Invention

The invention relates to a hand-operated stamp comprising a partially open-pored printing plate which is displaceable against a spring force from a resting position, in which it is retracted in a housing, into a printing position by means of an actuating unit, said printing plate resting on an ink storage member so as to receive stamping ink therefrom, said ink storage member being mounted in a retaining means which at least partially encloses the former.

Furthermore, the invention relates to an ink storage member unit for storing stamping ink for a partially open-pored printing plate of such a pre-inked stamp, comprising an ink storage member mounted in a retaining means enclosing the latter.

2. The Prior Art

Hand-operated stamps as initially mentioned are commonly termed pre-inked stamps. The stamping ink required for generating the stamping imprints is stored in the storage member which transfers the stamping ink to the stamping plate. The storage member may be based on the most varying technologies, such as a salt-washout process, a gel-system or a method using a foamed material (foamed vinyl material), yet the gel system has proved to be particularly advantageous. It is, however, also possible to integrate printing plate and storage member in one single element which contains the stamping ink to be imprinted (cf. e.g. U.S. Pat. No. 6,360,661 B1), yet in that case the production is comparatively complex.

In a more recent method, the so-called flash system, in an open-pored foamed material, such as, e.g., EVA (ethylene vinyl acetate), in those areas where no stamping imprint is to be made, a closing of the pores of the open-pored material is caused, so as to produce a unique printing plate, by short-term exposures ("flash"—in particular with the help of xenon lamps); on the other hand, in those areas in which a stamping imprint is to be made, the pores of the printing plate will remain open. In order to apply the desired image for the stamping imprint to the stamping plate blanks, previously cut EVA plates are inserted in an exposing device, i.e. together with a film which has the desired stamp imprint image which, e.g., has been made by means of a computer. By a single or repeated flash-like illumination, the printing plate is produced. For its operation, this EVA printing plate must then be supplied with stamping ink, for which the storage member, in particular the foamed PVA material (pre-)inked with the stamping ink is used.

Usually, such storage members are provided in bag packages. When the storage member, i.e. the pre-inked PVA material, is removed from the package and inserted in the stamp, this as a rule is not possible without soiling: Already when cutting open the package, the cutting tool (scissors, e.g.) is soiled by stamping ink, and subsequently, such soiling is also unavoidable for tweezers or a similar tool which will be used for removing the PVA material from the package and inserting it in the stamp housing.

DE 2 152 324 A describes a hand stamp having a porous stamping block and a storage member within a frame in a retaining means. What is disadvantageous here is the refilling of ink, since complete refilling of the storage member is only possible after a removal of the handle and a cover area with a protective film, since the filling piece is configured to be at the center.

From WO 02/28658 A, a hand-operated stamp is known which has a pre-inked, single-piece stamping plate arranged in a retaining means. What is disadvantageous here i.a. is that there is no storage member separate from the printing plate and that when exchanging the stamping plate which, at the same time, is the storage member, the types on the new stamping plate need to be produced anew.

In U.S. Pat. No. 5,855,170 A, a refillable stamp is disclosed in which a stamping plate, a cotton layer and a storage member are introduced in a retaining element. The retaining element is snapped in with an actuating part and displaceable relative to a housing. For refilling ink, the retaining element has two filling sockets. What is disadvantageous with this stamp is that mounting of the stamping plate together with the storage member will cause soiling, as mentioned before.

From U.S. Pat. No. 4,676,162 A, a stamp with a simple rubber stamping plate is known. In this case, the stamping plate is retained in a mount by means of a frame that has snap-in elements. Actuation is effected via a handle which—against the force of a spring—moves the mount with the stamping plate downwards within the stamp housing via a piston so as to produce a stamp imprint on a substrate. A disadvantage is that this stamp cannot be refilled, for which reason the entire stamp, and the stamping plate, respectively, must be exchanged when the stamping ink has been used up.

In U.S. Pat. No. 6,302,022 B1 a hand-operated stamp is shown which is to be considered to be the closest prior art, wherein a storage member is retained in a retaining means together with a stamping plate. These two parts are releasably interconnected via two separate, lateral, spring-mounted snap fasteners. For refilling ink, the latter is supplied via openings in a cover of the retention means. This stamp has, above all, the disadvantage of a complex fastening construction and, associated therewith, an expensive and cost-intensive production wherein, moreover, its handling during the refilling of ink (stamping ink) is cumbersome.

SUMMARY OF THE INVENTION

It is an object of the invention to remedy this situation and to provide a hand-operated stamp, and a storage member unit, respectively, as initially mentioned, where not only the risk of soiling is avoided when removing the storage member from a package and inserting it in the stamp housing and such removal and insertion is possible by means of simple manipulations, but it is also rendered possible in a most simple manner to remove a storage member from the stamp again after its stamping ink has been used up, such as for re-impregnating or, in particular, also for the purpose of exchanging said storage member. On the other hand, it shall also be possible to re-impregnate the storage member with stamping ink in situ, i.e. in a state inserted in the housing of the stamp. In this case, the design of the stamp shall be simple and require as few individual parts as possible.

To achieve this object, the invention provides for a hand-operated stamp as well as a storage member unit as defined in the independent claims. Advantageous embodiments and further developments are indicated in the dependent claims.

In the present hand-operated stamp, the ink storage member which, e.g., is made of PVA material (PVA—polyvinyl acetate), or of PE material (PE—polyethylene) is arranged in a trough-shaped retaining means which encloses or embraces the storage member and by means of which the storage member can be manipulated without soiling. The storage member unit comprised of storage member and retaining means thus can be removed from the package (which then may preferably be box-type) and inserted in a stamp housing without having to directly touch the storage material itself. It is particularly suitable if the retaining means encloses the storage member possibly on all sides, apart from its side facing the printing plate, and the retaining means, therefore, preferably is formed by a trough-shaped cassette. To keep the printing plate against the storage member—in the retaining means—in the completely mounted state, a coupling member is preferably provided on the retaining means; this coupling member may, e.g., be closed all around, i.e. be ring-shaped (wherein by ring shape a rectangular, closed shape, seen in top view, is to be understood). For coupling the printing plate to the storage member, the coupling member may extend over the printing plate at least in areas thereof. On the other hand, it may be provided for the coupling member to releasably latch with the retaining means, in particular the cassette.

A releasable connection by snapping in or latching is also provided between the retaining means and the actuating unit of the hand-operated stamp, i.e. via the connecting element; in particular, the connecting element may have two latching legs extending through an opening on the upper side of the stamp housing, which latching legs may be brought into engagement with latching projections in a latching depression (e.g. with under-cut walls) in the retaining means, such as in a bottom wall of the cassette. To simplify production, on the one hand, and assembling, or also disassembling, respectively, with a view to exchanging the storage member, on the other hand, it is, moreover, suitable if the connecting element is connected to an outer handle member of the actuating unit by latching or by snapping engagement, respectively.

The design with the latching legs may, furthermore, be advantageously used such that apart of the housing supporting a compression spring is arranged between the latching legs, the compression spring, on the other hand, being supported on an oppositely arranged region of the actuating unit or of the connecting part, respectively.

The latching legs may, moreover, be used with particular advantage for further functions. Thus, during pre-mounting of the actuating unit on the housing, before the ink storage unit is attached, the latching legs can latch the actuating means with the housing, and for this purpose it may be provided that, in a pre-mounting position, the latching legs engage behind the rim of the opening on the upper side of the housing by means of latching projections so as to connect the actuating unit with the housing. A further, particularly advantageous function in the sense of an ejection of a storage unit can be obtained if the latching legs include a control surface co-operating with the rim of the opening on the upper side of the housing, wherein the latching legs, when moving inwards into the housing interior beyond the stroke provided when making a stamp imprint, are resiliently deflected by the control surface so as to release the retaining means. In order to allow such inward movement of the latching legs to beyond the normal printing stroke, it may be necessary to remove the handle part before, i.e. if it is provided for the handle part to delimit the downward stroke by its lower rim, when making the imprint, by the rim abutting on a shoulder of the housing of the stamp.

In order to allow for a simple refilling of the stamping ink into the storage member, the trough-shaped retaining means is provided with at at least one ink refilling opening in the bottom wall of the trough. For distributing the stamping ink as quickly as possible over the storage member during a refilling procedure, it is also advantageous if groove-shaped channels radially extending in the bottom wall of the trough follow upon the ink refilling opening so as to distribute the ink over the storage member. Furthermore, the at least one filling socket is formed in the retaining means oriented towards the ink refilling opening. The filling socket can then facilitate refilling of the stamping ink like a filling hopper. On the other hand, an advantageous usage of the filling socket is also provided in that ink cartridges (spare cartridges) can be stored therein.

In pre-inked stamps and in flash-stamps, respectively, mostly an oil-based stamping ink is used which dries quickly and, consequently, may also quickly dry out. To counteract this, a cover cap releasably closing the lower opening of the housing may be associated with the housing, the cover preferably being latched with the housing.

Furthermore, the stamp housing may comprise anti-slip safety elements on its lower side which in each case will lie on the substrate to be stamped.

For a storage and delivery of the ink storage member unit, before the stamping plate is attached, it is suitable if the coupling member is attached, e.g. by friction fit, on that side of the retaining means that is opposite the opening for the attachment of the printing plate.

BRIEF DESCRIPTION OF THE DRAWINGS

In the following, the invention will be explained in more detail by way of particularly preferred exemplary embodiments illustrated in the drawings, without, however, being restricted to such embodiments. In detail.

DETAILED DESCRIPTION OF THE PREFERRED EMBODIMENTS

Figure 1:
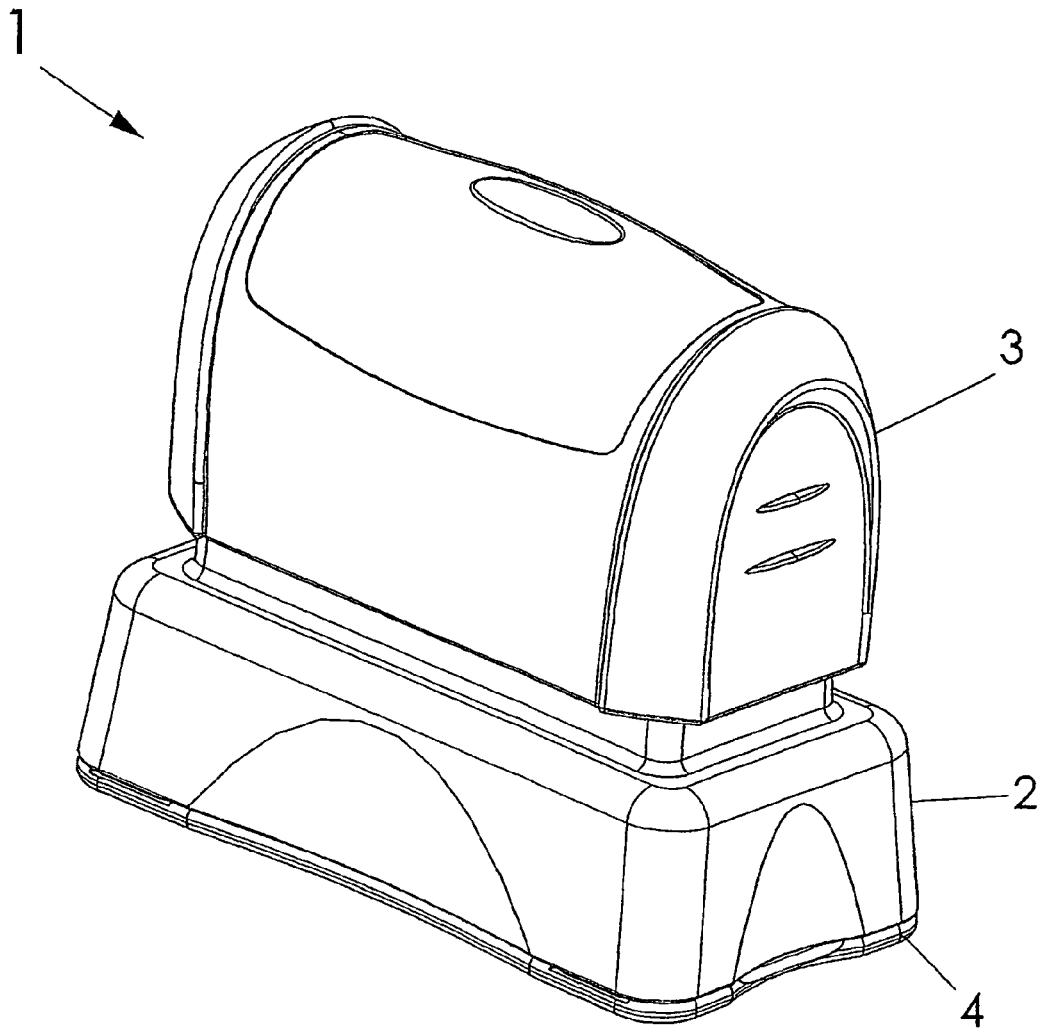
FIG. 1 shows a perspective view of a pre-inked hand-operated stamp.

In FIG. 1, a so-called pre-inked hand-operated stamp 1 is illustrated, this hand-operated stamp 1 containing a stamp housing 2 (called housing 2 in short hereinafter) as well as an actuating unit 3 put onto the former. On the lower side of the housing 2, a cover 4 having the form of a cover cap is snapped on so as to close the stamp lower side as far as possible and to counteract drying out of the ink contained therein.

Figure 2:
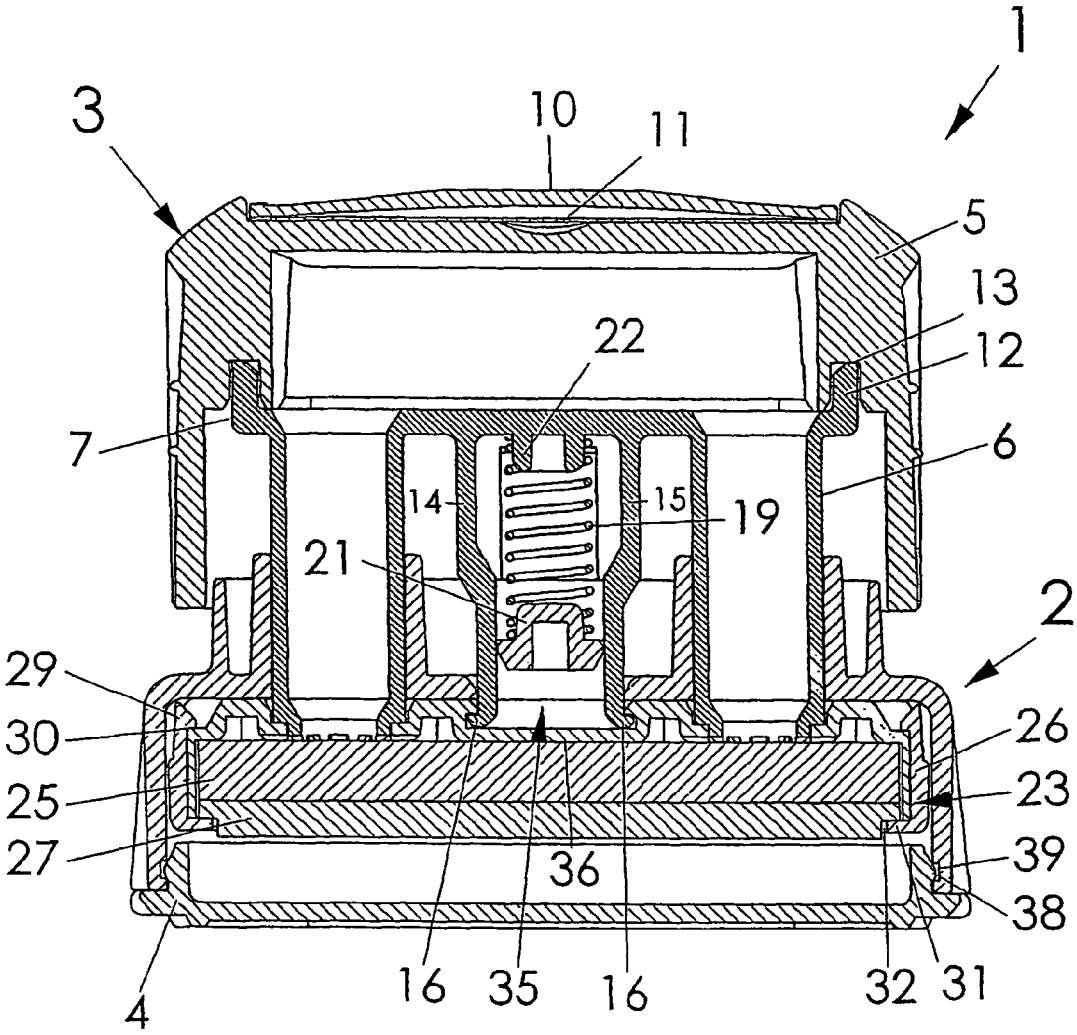
FIG. 2 shows a longitudinal section through this hand-operated stamp of FIG. 1 in its resting position.
Figure 3:
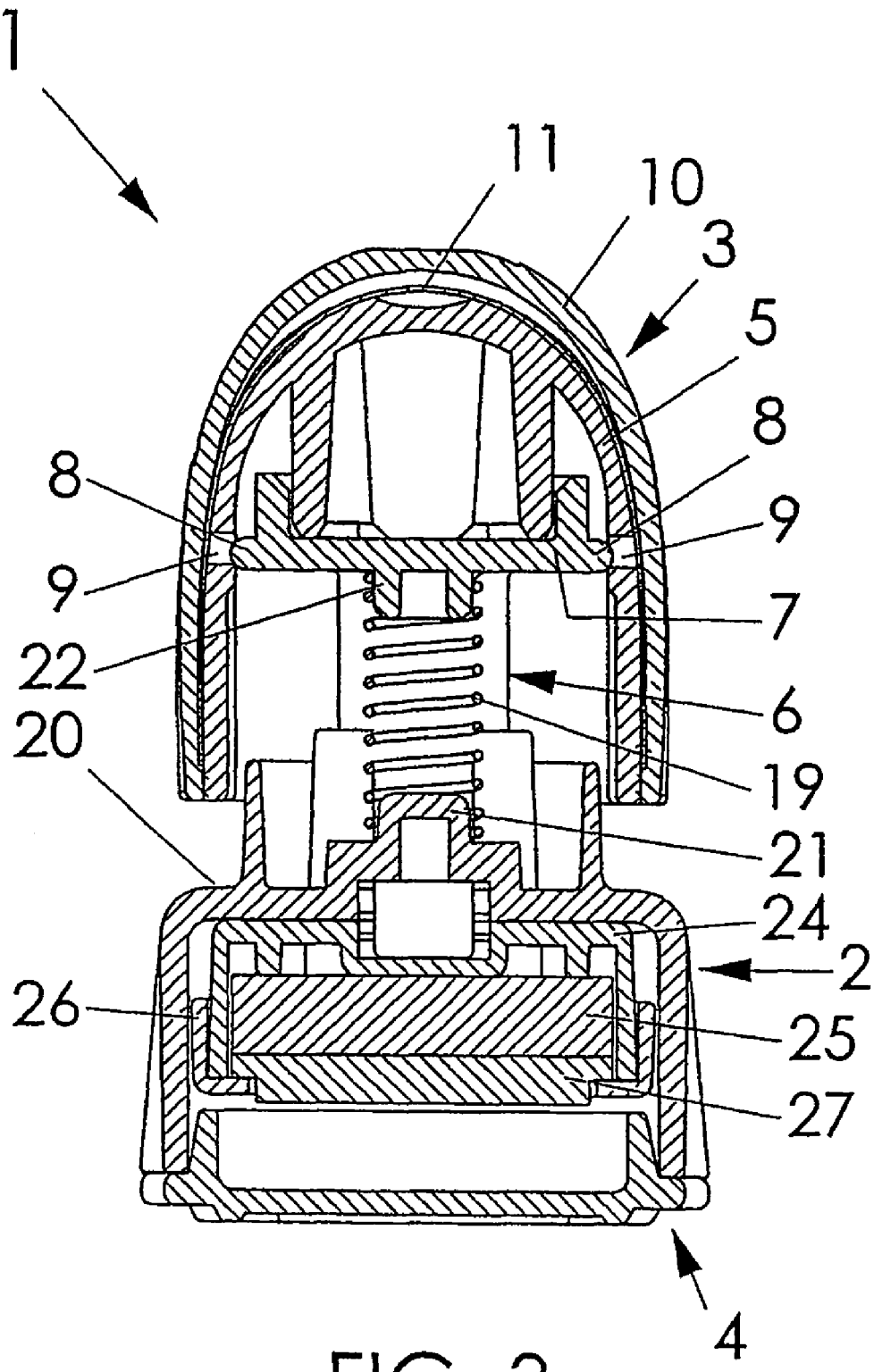
FIG. 3 shows a cross-section through this hand-operated stamp according to FIGS. 1 and 2.
Figure 4:
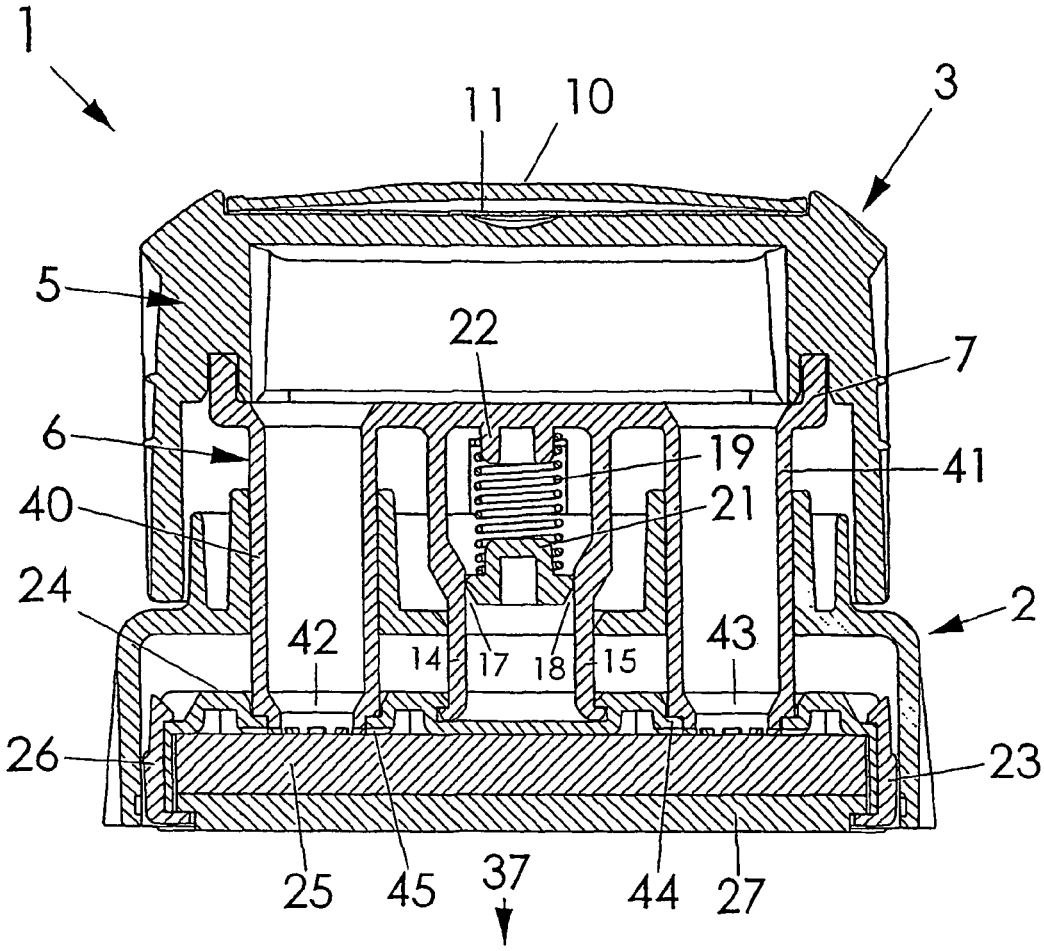
FIG. 4 shows a longitudinal section similar to FIG. 2, wherein, however, in FIG. 4 the printing position of the hand-operated stamp is shown.

As is particularly visible from FIGS. 2 to 4, the actuating unit 3 of the hand-operated stamp 1 has two parts, with an upper or handle part 5, on the one hand, and a lower or inner connecting part 6, on the other hand being provided. These two parts 5, 6 are interconnected by latching, latching projections 8 being provided on the two longitudinal sides of an upper trough portion 7 of the connecting part 6 and engaging in associated latching recesses 9 of the handle part 5 in the mounted state, cf. also FIG. 9 in addition to FIGS. 2 to 4. From FIG. 3 it is, furthermore, visible that the handle part 3 may comprise a hood 10 which, preferably, is transparent so as to allow a lettering sheet 11 arranged therebelow to be read.

For securing its position, the connecting part 6 projects into corresponding depressions 13 of the handle part 5 by means of the rim 12 of the trough portion 7, cf. in particular FIG. 2. Furthermore, the connecting part 6 comprises latching legs 14, 15 below the trough portion 7 and integrally formed therewith, which latching legs are substantially plate-shaped, cf. also FIG. 9, and which have hook-shaped, outwardly projecting latching projections 16 on their free lower ends. In their mounted position, cf. e.g., FIGS. 2 and 4 as well as also FIG. 9, these latching legs 14, 15 pass through openings 17, 18 provided on the upper side 20 of the housing 2, and in the pre-mounted position of actuating unit 3 and housing 2, cf. FIG. 5, they engage behind the rims of the openings 17, 18 with their hook-shaped latching projections 16.

Between the latching legs 14, 15, a helical compression spring 19 is arranged which rests in the region of a centering projection 21 in the housing upper side 20, on the one hand, and on a retaining projection 22 on the inner side of the connecting part 6, on the other hand. This compression spring 19 presses the two components, actuating unit 3 and housing 2, asunder so that the latching projections 16 in the pre-mounted position according to FIG. 5 rest under spring pressure on the lower side of the rims of the openings 17, 18.

Figure 5:
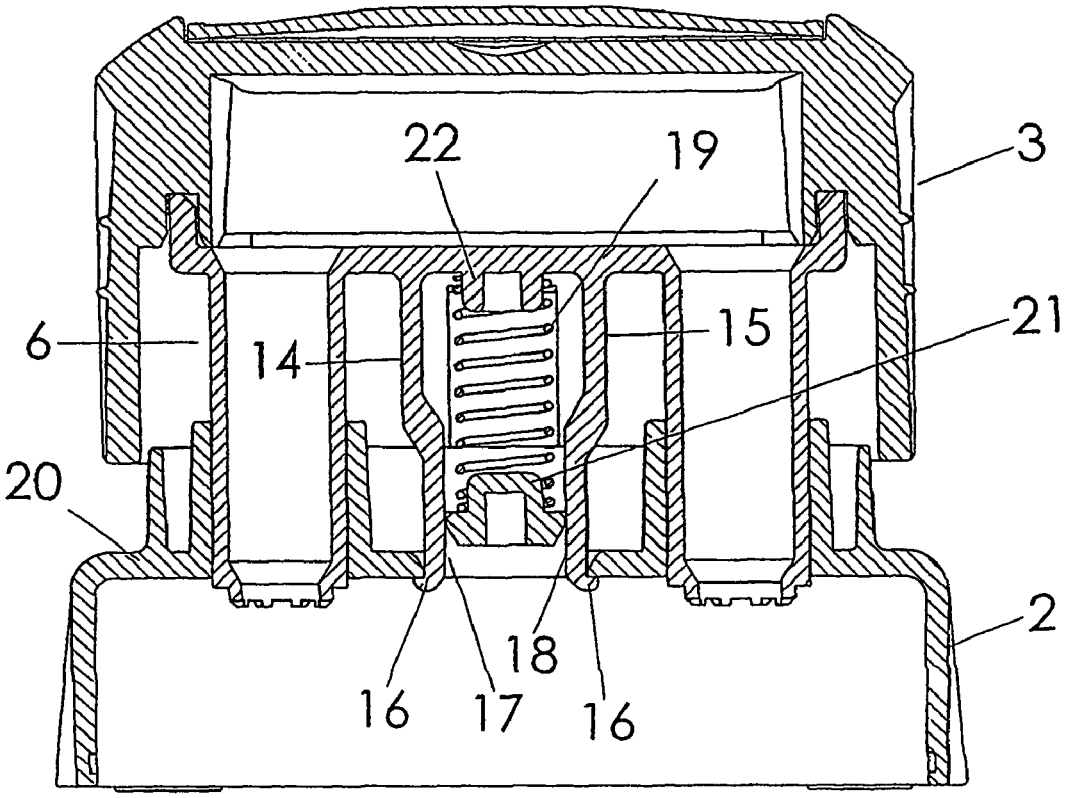
FIG. 5 shows a comparable longitudinal section through the stamp housing and actuating unit of the hand-operated stamp according to FIGS. 1 to 4 in a pre-mounted position, yet still without the ink storage member unit.

From the pre-mounted position according to FIG. 5, the actuating unit 3 and the housing 2 can be further pushed together, relative to each other, so as to connect the latching projection 16 with an ink storage member unit 23 by latching or snapping engagement, respectively. As can particularly be seen from FIGS. 9, 10 and 11, this ink storage member unit 23 comprises a retaining means 24 for a storage member 25 which consists of a foamed material, in particular PVA or PE, and serves for storing stamping ink. The storage member 25 may be pre-mounted in the trough-shaped retaining means, or cassette 24, respectively, by gluing or by press fit. In this pre-mounted configuration, in combination with a rectangular, ring-shaped coupling member 26 seen in top view, the storage member unit 23 (without printing plate 27, cf. FIGS. 9 and 10) can be stored, or delivered, respectively, in a box-shaped package 28, cf. FIG. 8. When inserting the storage member 25 held in the retaining means, or cassette 24, respectively, into the hand-operated stamp 1, e.g. at the location of respective user of the stamp, the desired printing plate 27, which previously has been produced according to the initially described flash method, is applied to the lower side of the storage member 25 and mounted on the storage member unit 23 by removing the ring-shaped coupling part 26 from the cassette 24 (in the position according to FIG. 8) and slipping on and snapping on the coupling part 26 from the lower side of the cassette 24 (cf. the arrangement according to FIG. 10 or FIG. 9), wherein the coupling member 26 snaps in behind latching shoulders 30 of the cassette 24 with the help of latching hooks 29 and, thus, in this mounted operating position keeps the printing plate 27 tightly pressed against the storage member 25. The coupling member 26 thus engages below a step-shaped, offset rim 32 of the printing plate 27 by means of an inwardly projecting flange rim 31, cf. also FIG. 2.

Figure 8:
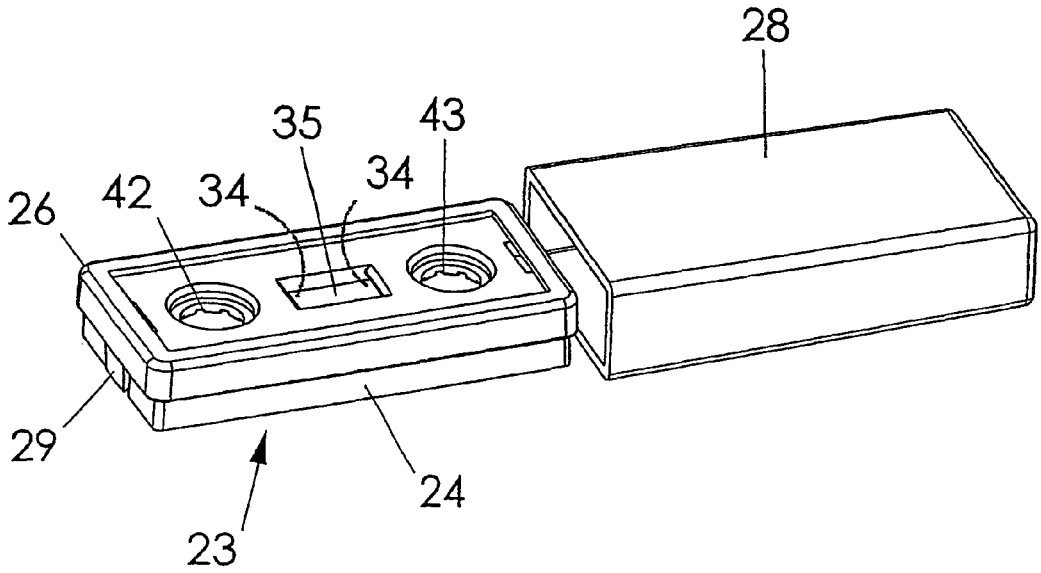
FIG. 8 shows a perspective view of a storage member unit with a ring-shaped coupling member, yet without printing plate, wherein the coupling member is still present on the upper side of the storage member.
Figure 9:
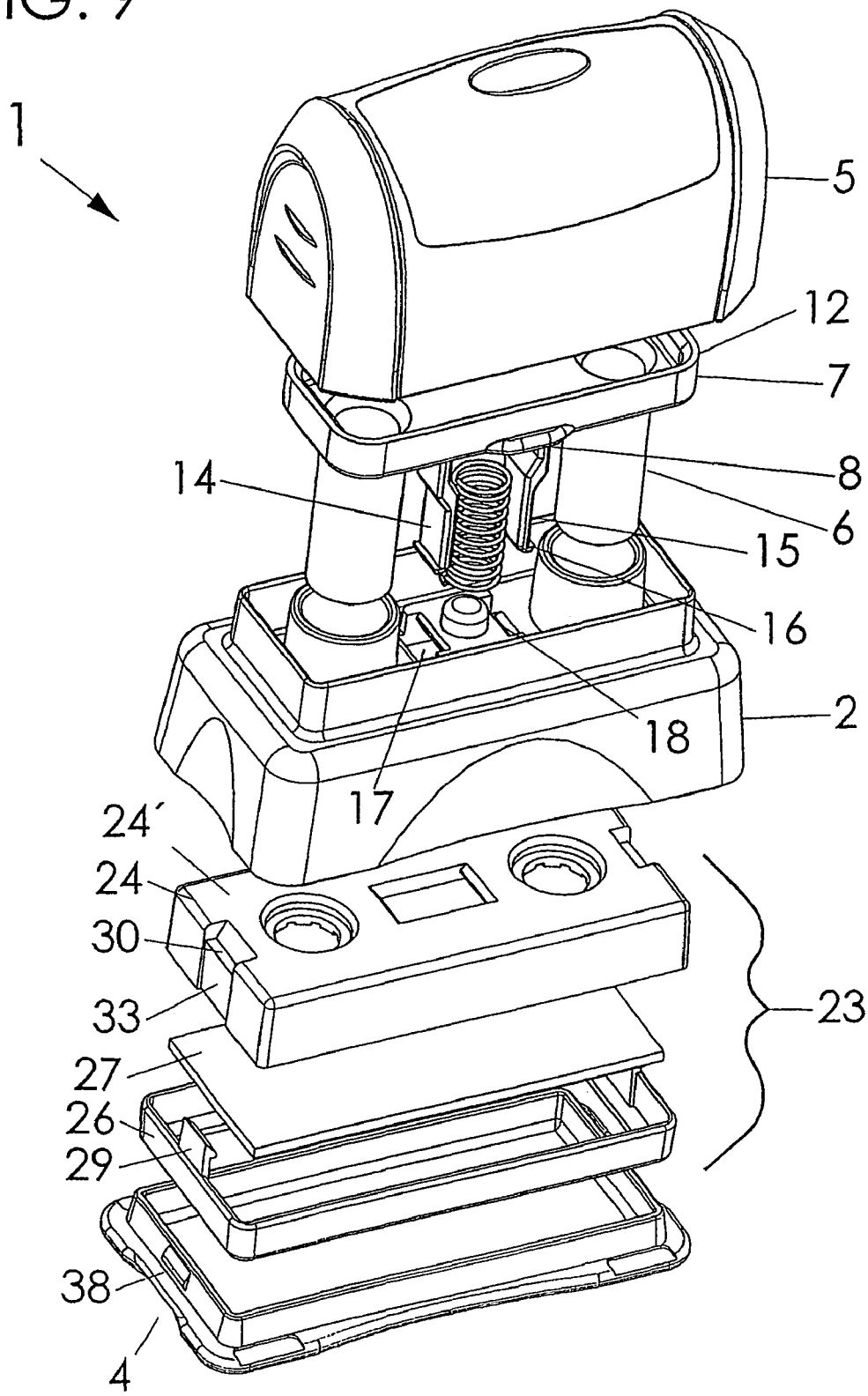
FIG. 9 is an exploded illustration of the elements of the hand-operated stamp according to FIGS. 1 to 7.
Figure 10:
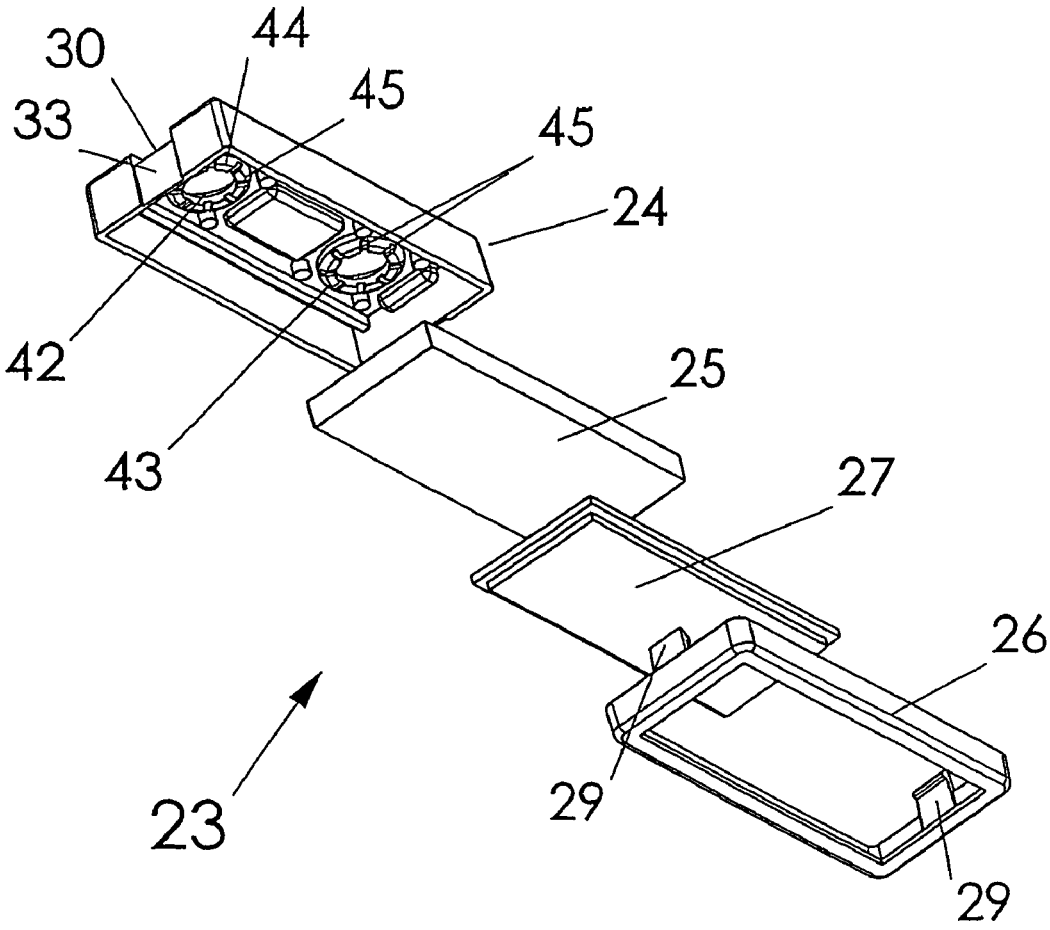
FIG. 10 shows an exploded perspective illustration of the elements of a storage member unit including a printing plate.

In the arrangement of the storage member unit 23 for delivery according to FIG. 8, in which the coupling member 26 is still put onto the cassette 24 from above, the latching projections 29 of the coupling member 26 simply abut on the side of the cassette 24 by frictional engagement, this being in the region of the wall depressions 33, cf. FIGS. 9 and 10.

In the resting position of the hand-operated stamp 1 illustrated in FIGS. 2 and 3, the storage member unit 23 (now including the printing plate 27) is retracted into the interior of the housing 2, and it is connected to the latching legs 14, 15 by latching engagement of the latching projections 16 below under-cut rims 34 of a latch or latch depression 35 on the upper side or upper (bottom) wall 24' of the cassette 24. With their lower sides, the latching projections 16 in this position abut on the bottom 36 of the latch (latch depression) 35, so that the storage member unit 23 can be shifted—against the force of the compression spring 19—from the resting position according to FIGS. 2 (and 3) into the printing position according to FIG. 4 during a downward movement of the actuating unit 3. Before the stamping imprint is made by such an actuation, moving the storage member unit 23 including the printing plate 27 downwards according to the illustration of the drawing, cf. also the arrow 37 in FIG. 4, the cover 4 still shown in FIG. 2 has to be removed from the housing 2. This cap-shaped cover 4 is releasably connected to the housing 2 by a latching engagement via lateral latching projections 38 and matching latching depressions 39 provided on the inner side of the housing 2, cf., e.g., FIGS. 2 and 9.

In detail, when actuating the hand-operated stamp 1, the force exerted on the handle part 5 is transmitted to the cassette 24 via the trough portion 7 and, thus, also via the connecting part 6, the latching legs 14, 15 serving this purpose, on the one hand, yet also sockets 40, 41, on the other hand, which engage in step-shaped refilling openings 42, 43 of the cassette 24 when the storage member unit 23 has been mounted. These sockets 40, 41 may be used as refilling sockets for refilling stamping ink into the storage member 25—with the handle part 5 removed—apart from the fact that they also serve for transmitting force during the actuation of the stamp.

The refilling openings 42, 43 may, e.g., be circular, and on the lower side of the opening rims 44, groove-shaped channels 45 are formed which are radially arranged or arranged in star-shape, which channels facilitate the distribution of stamping ink over the storage member 25 during the refilling of said stamping ink.

The printing position of the stamp 1 is shown in FIG. 4, wherein it can be seen that in this position the "bow", i.e. the actuating unit 3 with its handle part 5, comes to abut on the upper side 20 (cf. FIG. 5) of the housing 2 to thereby restrict the stroke when making the stamp imprint.

Figure 6:
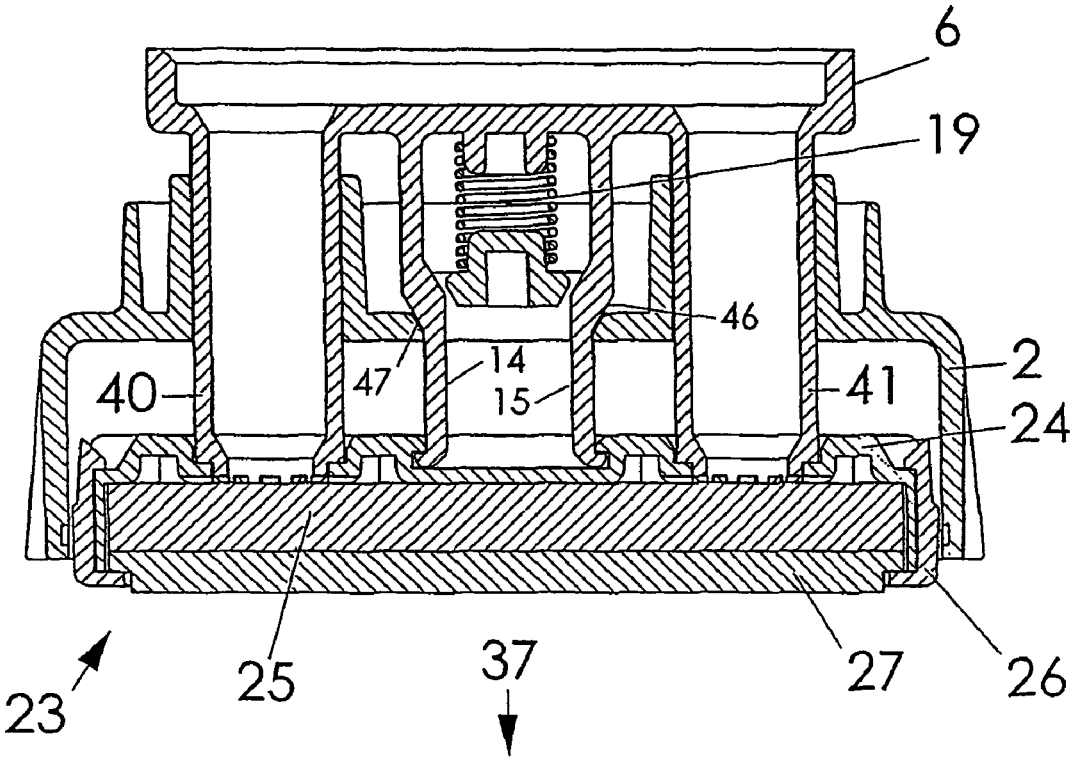
FIGS. 6 and 7 show the process when ejecting a storage member unit in longitudinal sections similar to FIG. 4, with the handle member of the actuating unit having been removed.
Figure 7:
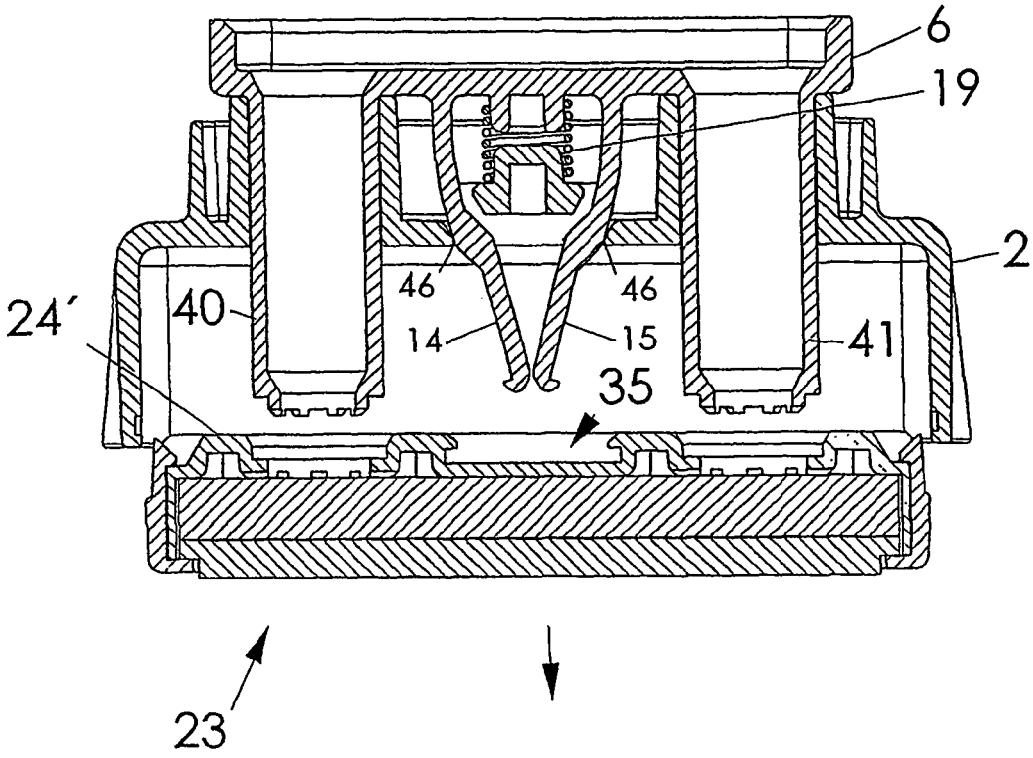
Figure 11:
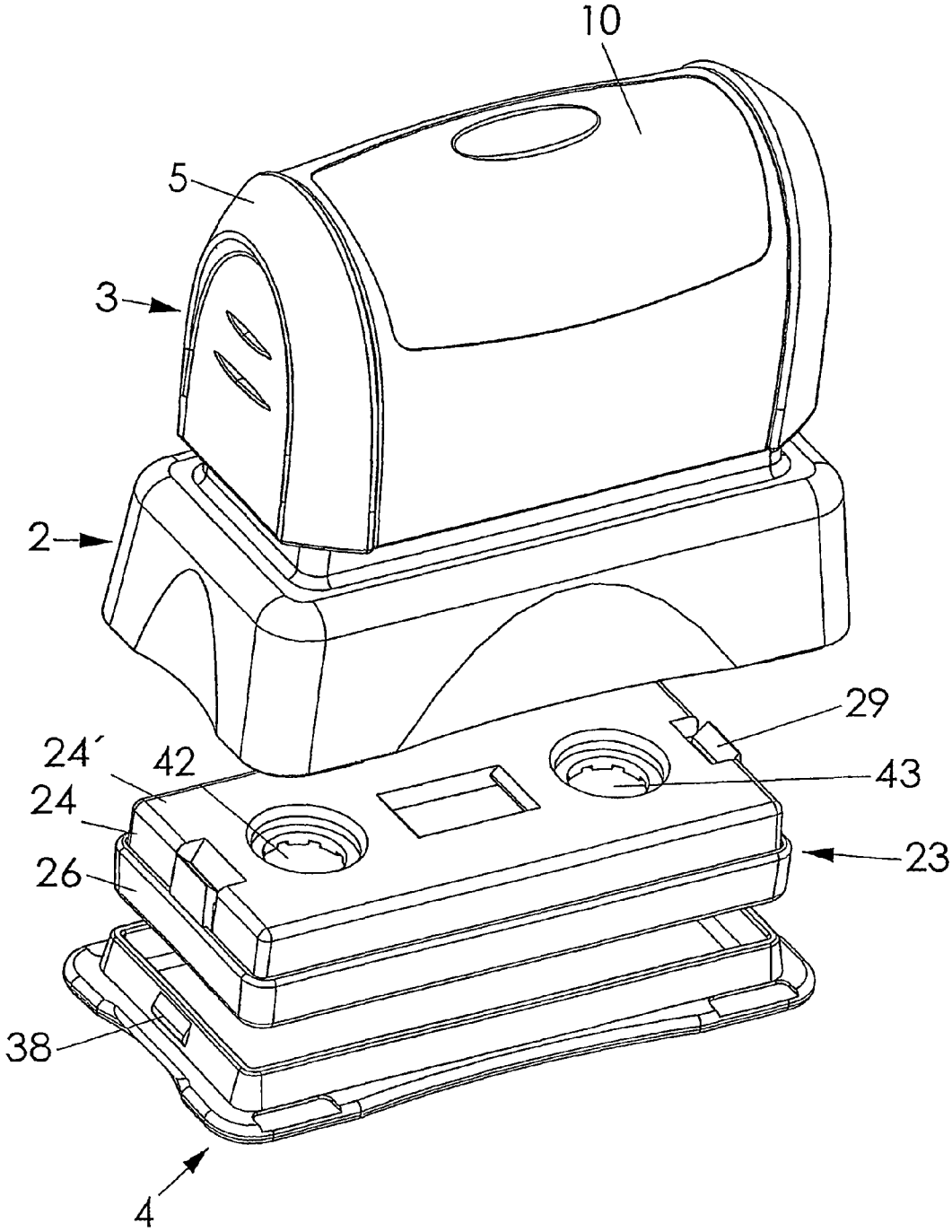
FIG. 11 shows a component consisting of stamp housing and actuating unit in the pre-mounted position, a storage member unit as well as a cover that can be snapped in on the lower side of the housing, also in an exploded, perspective illustration.

If, starting out from the position according to FIG. 4 and with the handle part 5 removed, the connecting part 6 is moved further downwards—against the spring force of the compression spring 19, cf. arrow 37 in FIG. 6,—inclined cam surfaces 46 externally provided on the latching legs 14, 15, i.e. at the sides facing away from each other, will move up against slanted opening rims 47 of the openings 17, 18 on the upper side 20 of the stamp housing, and when moving the connecting part 6 further downwards, the latching legs 14, 15 will be deflected towards each other, as can be seen in FIG. 7, from their resting position shown in FIG. 6 to the release position shown in FIG. 7. Thereby the cassette 24 with the storage member 25, the printing plate 27 and the coupling member 26 will be released so that these four items will be released as a unit, as can be seen in FIG. 11 (storage member unit 23), so as to allow either refilling of stamping ink externally of the stamp housing 2, or exchanging of this unit 23. The latching legs 14, 15, thus may also be termed (cam) coulisses for controlling the release of the unit 23. In the exemplary embodiment illustrated, the cam surfaces 46 are formed in that the latching legs 14, 15 are twice angled, i.e. cranked; yet, it would, of course, also be conceivable to simply mould control cams to the latching legs 14, 15, which control cams will form the cam surfaces 46.

Figure 12:
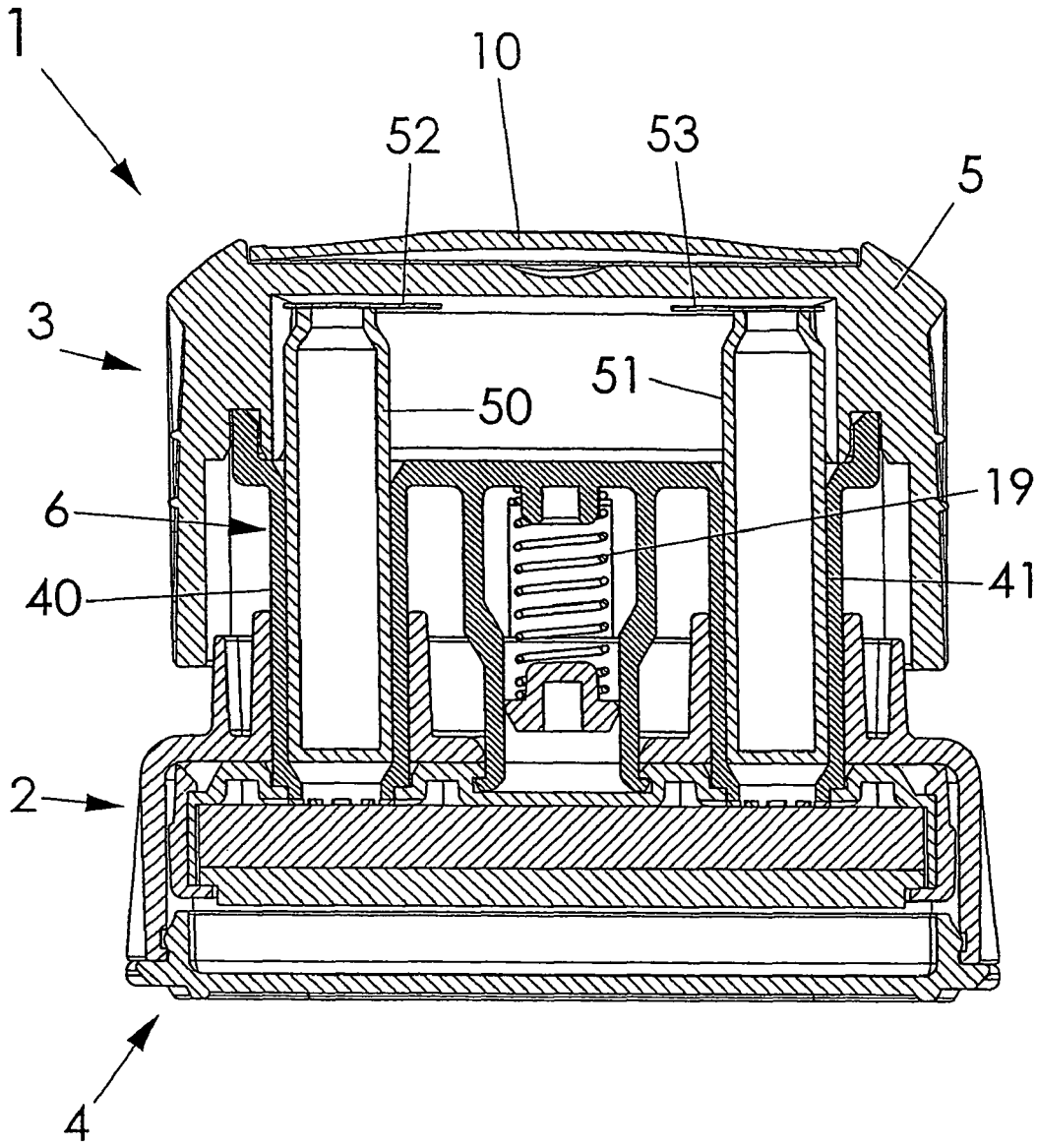
FIG. 12 shows an embodiment of the hand-operated stamp with ink refill cartridges in a longitudinal section similar to FIG. 2.
Figure 13:
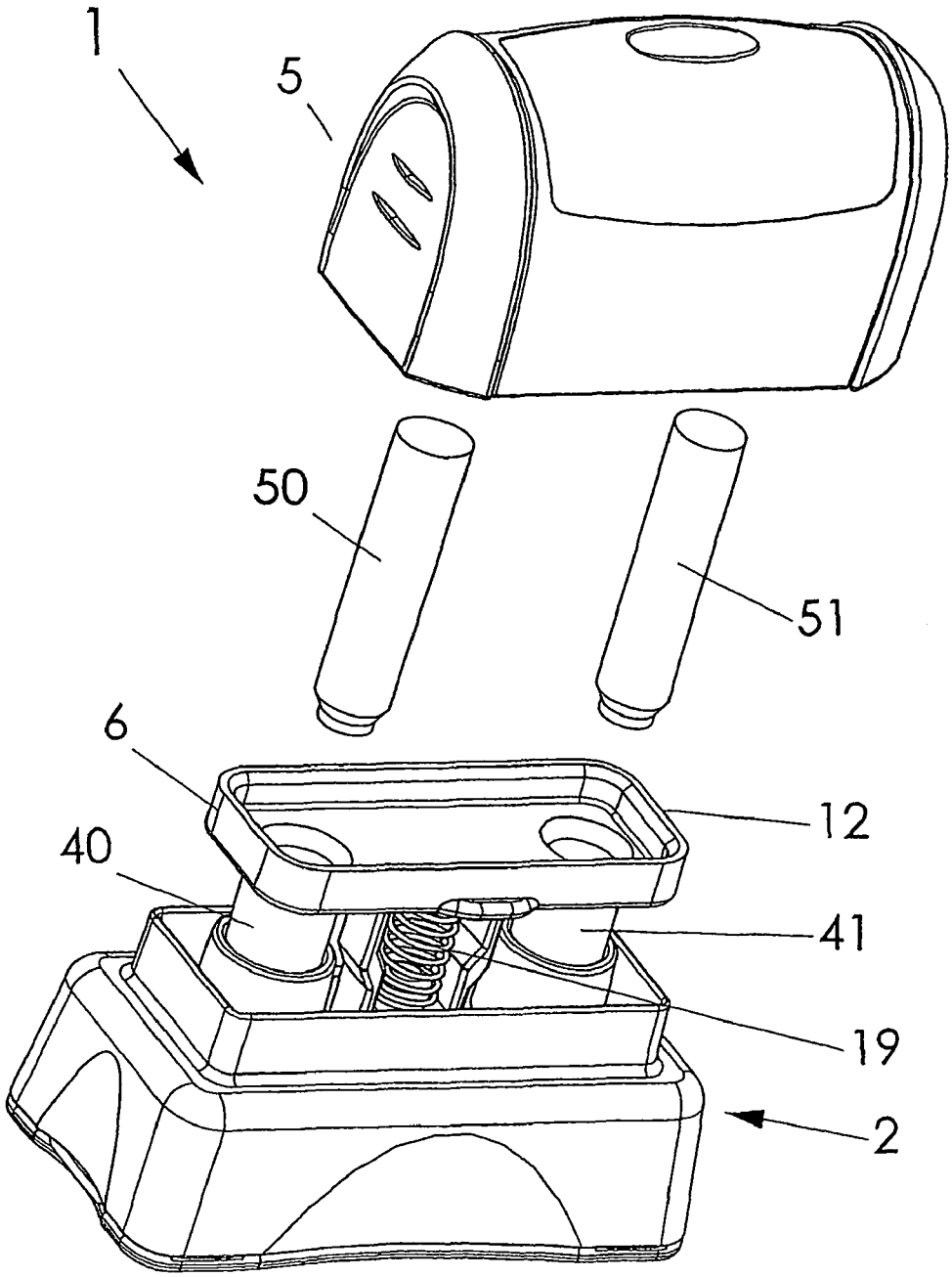
FIG. 13 shows an exploded illustration of this hand-operated stamp according to FIG. 12.

The embodiment of the present hand-operated stamp 1 as illustrated in FIGS. 12 and 13 largely corresponds to that according to FIGS. 1 to 11, and therefore the construction of this hand-operated stamp 1 need not be described again, as far as there exists a correlation. Different from the embodiment according to FIGS. 1 to 11, there is a further use of the sockets 40, 41 of the connecting part 6 of the actuating unit 3 in the hand-operated stamp 1 according to FIGS. 12 and 13, i.e. the accommodation of stamping ink refilling cartridges 50, 51, wherein these refilling cartridges may be closed on their upper sides with a cover film 52, 53.

Figure 14:
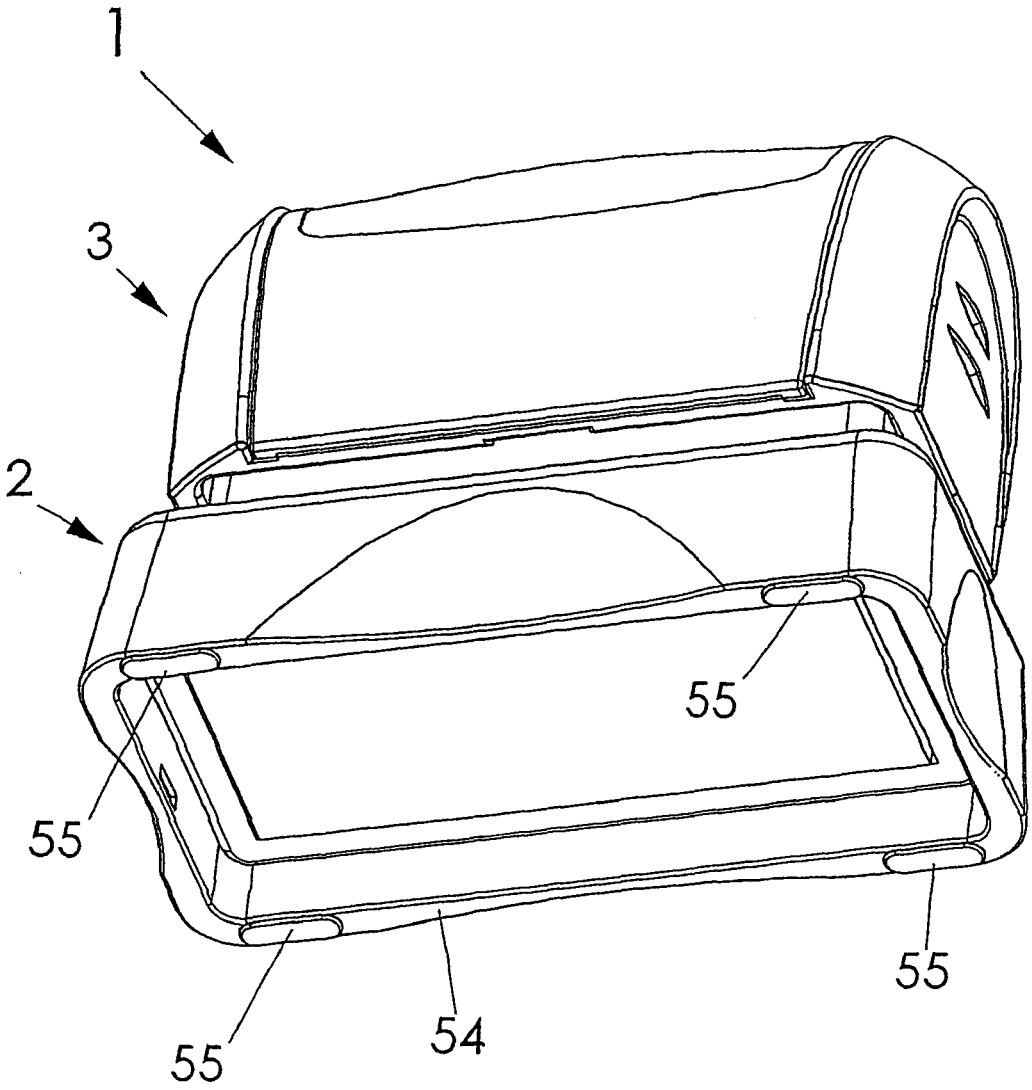
FIG. 14 shows a perspective bottom view of the hand-operated stamp according to FIG. 1 or 12, to illustrate anti-slip safety elements on the lower side of the stamp housing.

Finally, it can be seen from FIG. 14 that on the lower side of the housing 2 which, there, is frame-shaped, anti-slip safety elements 55 may be attached on the housing contact surface 54, e.g. made of a comparatively soft elastomer material that has a high friction.

The individual components of the hand-operated stamp 1 described preferably are made of a synthetic material. In particular, the cassette 24 may, e.g., be made of a thermoplastic, such as, in particular, ABS, whereas the ring-shaped coupling member 26 may be made of POM or of polycarbonate, yet optionally also of ABS. The storage member is, e.g., of foamed PVA or PE material, the latter being preferred since in case of an impression, an elastic deformation and a return to its original state will occur, whereas PVA material impressions will last; the printing plate 27 is, in particular, made of foamed EVA material whose pores, on the printing side, in those areas, where no imprint shall be made, have been closed by the so-called flash method by welding during light exposure, as has been described.

The invention claimed is:

1. A hand-operated stamp comprising a partially open-pored printing plate which is displaceable against a spring force from a resting position, in which said printing plate is retracted in a housing, into a printing position by means of an actuating unit, said printing plate resting on an ink storage member so as to receive stamping ink therefrom, said ink storage member being mounted in a retaining means at least partially enclosing said ink storage member, wherein the retaining means is a separate trough-shaped retaining member which is directly latched with a separate connecting part which, in turn, is latched with the actuating unit, said separate connecting part having at least one refilling socket oriented towards an ink-refilling opening in the bottom wall of the retaining member.

2. The hand-operated stamp according to claim 1, wherein the connecting part has two latching legs extending through openings on the upper side of the housing for latching engagement with a latch provided on a wall part of the retaining member.

3. The hand-operated stamp according to claim 2, wherein the connecting part is latched with an external handle part of the actuating unit.

4. The hand-operated stamp according to claim 2, wherein a part of the housing supporting a compression spring is arranged between the latching legs, the compression spring on the other hand being supported on an oppositely arranged area of the actuating unit or of the connecting part, respectively.

5. The hand-operated stamp according to claim 2, wherein in a pre-mounted position, the latching legs engage behind the rim of the openings on the upper side of the housing by means of latching projections so as to connect the actuating unit with the housing.

6. The hand-operated stamp according to claim 2, wherein the latching legs include a cam surface cooperating with the rim of the openings on the upper side of the housing, wherein the latching legs, when moving inwards into the housing interior beyond the stroke provided when making a stamp imprint, are deflected by the cam surface for releasing the retaining means.

7. The hand-operated stamp according to claim 1, wherein for distributing ink over the storage member, radially extending, groove-shaped channels follow upon the ink refilling opening in the bottom wall of the trough-shaped retaining member.

8. The hand-operated stamp according to claim 1, wherein the at least one filling socket is designed for accommodating an ink cartridge.

9. The hand-operated stamp according to claim 1, wherein the housing has anti-slip safety elements provided on its lower side.

10. The hand-operated stamp according to claim 1, wherein the housing has an associated cover releasably closing the lower side thereof.

11. The hand-operated stamp according to claim 10, wherein the cover can be latched, or is latched, respectively, with the housing.

12. The hand-operated stamp according to claim 1, wherein the retaining member is formed by a cassette.

13. The hand-operated stamp according to claim 1, wherein a coupling member is provided on the retaining member for coupling the printing plate to the storage member.

14. A hand-operated stamp according to claim 13, wherein the coupling member engages over the printing plate at least in parts thereof.

15. The hand-operated stamp according to claim 13 , wherein the coupling member can be latched, or is latched, respectively, with the retaining member.

* * * * *